US005131468A

United States Patent [19]

Lane et al.

[11] Patent Number: 5,131,468

[45] Date of Patent: Jul. 21, 1992

[54] PACKER SLIPS FOR CRA COMPLETION

[75] Inventors: Andrew R. Lane, Houston; R. Brooks Wheeler, Carrollton, both of Tex.; Alan T. Jackson, Victoria Island, Nigeria

[73] Assignee: Otis Engineering Corporation, Carrollton, Tex.

[21] Appl. No.: 684,303

[22] Filed: Apr. 12, 1991

[51] Int. Cl.[5] ..... E21B 33/129

[52] U.S. Cl. ..... 166/120; 166/134

[58] Field of Search ..... 166/120, 134, 217; 175/410

[56] References Cited

U.S. PATENT DOCUMENTS

| | | | |
|---|---|---|---|
| 2,743,781 | 5/1956 | Lane | 166/212 |
| 4,044,826 | 8/1977 | Crowe | 166/120 |
| 4,081,203 | 3/1978 | Fuller | 175/410 X |
| 4,258,787 | 3/1981 | Amancharla | 166/120 |
| 4,545,431 | 10/1985 | Fore | 166/134 X |

*Primary Examiner*—William P. Neuder

*Attorney, Agent, or Firm*—Dennis T. Griggs

[57] ABSTRACT

A packer slip has multiple anchor studs which are press fit in an interference union onto a slip plate constructed of a corrosion resistant alloy material. The anchor studs are located on the slip plate in such a manner as to distribute applied load forces evenly onto the well casing. The anchor studs have ribs formed by longitudinal serrations, with the stud body and ribs being truncated along a planar face, thereby producing a cutting edge for penetrating and gripping a well casing, which is also constructed of corrosion resistant alloy material. The ribs are separated circumferentially by longitudinal grooves formed in the main body portion of each stud. According to this arrangement, the grooves provide flow space for rib material which flows in response to compression forces arising as a press-fit interference union is produced. Each stud is made of a material which has a hardness which is substantially greater than the hardness of CRA alloy casing material, such as carbide compounds including refractory carbides and cemented refractory carbides.

45 Claims, 2 Drawing Sheets

PACKER SLIPS FOR CRA COMPLETION

FIELD OF THE INVENTION

This invention relates to tools and equipment for completing subterranean wells, and in particular to well packers for securely sealing the annulus between a tubing string and the bore of a surrounding well casing.

BACKGROUND OF THE INVENTION

In the course of treating and preparing subterranean wells for production, a well packer is run into the well on a work string or production tubing. The purpose of the packer is to support production tubing and other completion equipment such as a safety valve above the packer or a screen adjacent to a producing formation and to seal the annulus between the outside of the production tubing and the inside of the well casing to block movement of fluids through the annulus past the packer location. The packer is provided with slip anchor members having opposed camming surfaces which cooperate with complementary opposed wedging surfaces, whereby the slip anchor members are extendable radially into penetrating, gripping engagement against the well casing bore in response to relative axial movement of the wedging surfaces. The packer also carries annular seal elements which expand radially into sealing engagement against the bore of the well casing in response to axial compression forces. Longitudinal movement of the packer components which set the anchor slips and the sealing elements may be produced hydraulically, mechanically or by electric wire line explosive powder setting tools.

DESCRIPTION OF THE PRIOR ART

Many factors must be considered in selecting materials for completion components. These include mechanical properties/strength and corrosion embrittlement, or stress corrosion cracking resistance. Other factors to be considered are downhole environmental conditions including oil or gas well service, bottom hole pressure and temperature, percent $H_2S$, percent $CO_2$, salt, chloride or other mineral concentrations in water, in situ pH or acidity of formation fluid, water production rate, oxygen content of injected fluids, type of chemical inhibitor used, expected time between workovers and corrosion history.

In harsh well environments, corrosion resistant alloy (CRA) metals are used for constructing the well casing and packer components. For example, permanent packers set in highly corrosive wells may utilize CRA materials. Conventional CRA materials include INCALOY 925, INCONEL 718, HASTALOY, and CARPENTER 20.

Conventional packer slips have been made from carbon steel, either type 1018 or 8620 alloy steel materials. The anchor teeth are usually hardened, for example by case carburization or induction hardening, so that they will have a minimum hardness value of at least 58 on the RC hardness scale. To insure reliable penetration and gripping action against the casing, the anchor slip material should have a hardness which is substantially greater than the hardness of the well casing material. A significant difference in hardness is essential for reliable penetration into the well casing.

Some wells have harsh downhole conditions which are destructive to conventional type 1018 or 8620 well casing materials. Consequently, such wells have been completed with corrosion resistant alloy (CRA) materials, including the casing, the packer mandrel and the bottom sub.

The CRA casing has a minimum yield strength of 105,000–125,000 psi. There is presently no technology available to produce a CRA slip which is sufficiently harder than the CRA casing material. That is, there is presently no manufacturing process known for case hardening the CRA slip base. Consequently, conventional packer slips for use in CRA casing applications have been constructed of ordinary carbon steel, either 1018 or 8620 materials, and are carburized and case hardened to obtain the requisite 58 point minimum hardness. However, the use of non-CRA materials for constructing the packer slips renders them vulnerable to chemical attack and early failure in highly corrosive well applications.

Another limitation in the use of CRA materials for constructing the packer slips is that the conventional method of attaching the anchor teeth onto the packer slips is by the use of a nickel brazing process. Such brazing techniques cannot be used to attach hardened anchor teeth onto the CRA slip body, since the CRA material is not wettable by the brazing flux filler material.

OBJECTS OF THE INVENTION

Accordingly, the principal object of the present invention is to provide a well packer having anchor slips which can be used in well completions in which the completion components, including the well casing, are constructed of corrosion resistant alloy (CRA) materials.

A related object of the invention is to provide an anchor slip for a well packer in which the anchor slip is constructed of a corrosion resistance alloy material, and the anchor teeth have a hardness which is greater than the CRA material.

Another object of the present invention is to provide an improved anchor slip assembly in which penetration and gripping action against the well casing is achieved by multiple anchor studs mounted on a slip plate.

Still another object of the present invention is to provide an improved anchor stud for attachment to an anchor slip made of CRA material.

A related object of the present invention is to provide an improved method for attaching an anchor stud onto an anchor slip plate constructed of CRA material.

SUMMARY OF THE INVENTION

The foregoing objects are achieved according to the present invention by a packer slip having multiple anchor studs which are press fit in an interference union onto a slip plate. The anchor studs have ribs formed by longitudinal serrations, with the stud body portion and ribs being truncated along a planar face, thereby producing a cutting edge for penetrating and gripping a well casing.

The body portion and ribs are also truncated along an annular face on the opposite end for insertion into a socket bore formed in the slip plate. The ribs are separated circumferentially by longitudinal grooves formed in the main body portion. According to this arrangement, the grooves provide expansion space for rib material which flows in response to the compression forces which arise as the press-fit interference union is produced.

Each stud is made of a material which has a hardness which is substantially greater than the hardness of CRA alloy casing material, such as tungsten carbide compounds including refractory carbides and cemented refractory carbides.

The novel features of the invention are set forth with particularity in the claims. The invention will best be understood from the following description when read with reference to the accompanying drawings.

DETAILED DESCRIPTION OF THE PREFERRED EMBODIMENT

Figure 1:
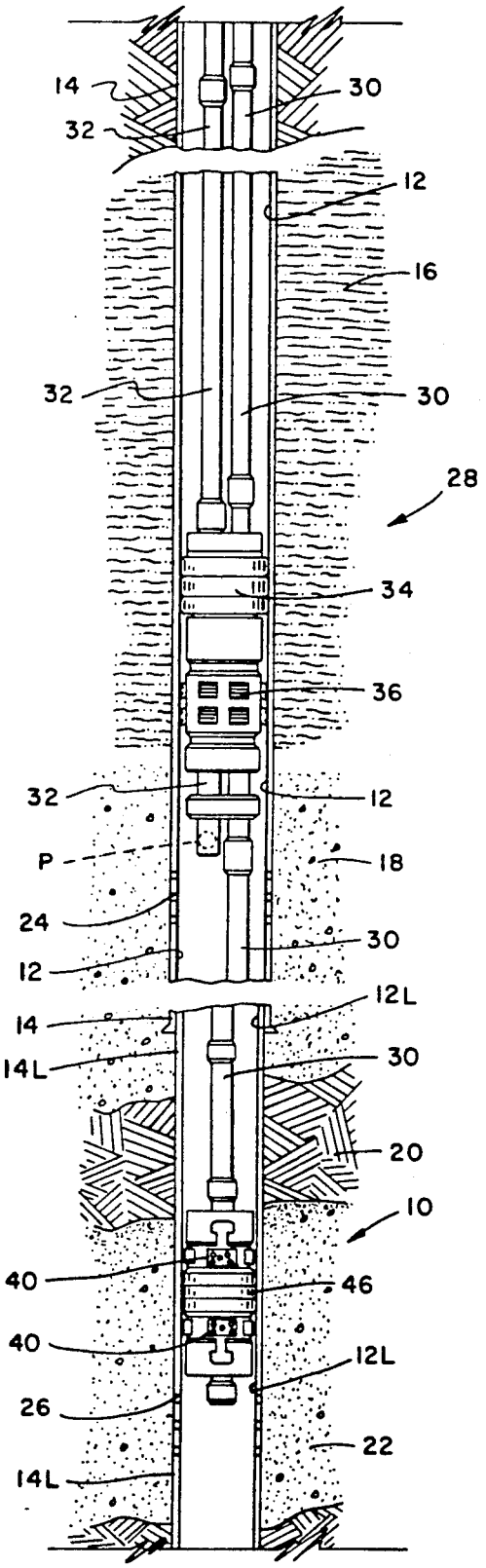
FIG. 1 is a simplified schematic diagram showing a production well intersecting two hydrocarbon producing formations, with the lower producing formation being subject to highly corrosive conditions, and being isolated by a single string bottom packer having corrosion resistant components, including an anchor slip assembly constructed according to the teachings of the present invention.

In the description which follows, like parts are marked throughout the specification and drawings with the same reference numerals, respectively. The drawings are not necessarily to scale and the proportions of certain parts have been exaggerated to better illustrate details and features of the invention. As used herein, the designation "T" refers to a threaded union.

Anchor slip apparatus constructed according to the preferred embodiment of the present invention is incorporated in a single bore bottom packer 10 which is shown in permanently set, sealed engagement against the bore 12L of a tubular liner casing 14L. An upper tubular well casing 14 extends through multiple layers of overburden 16, traversing a first hydrocarbon formation 18. The lower liner casing string 14L, constructed of a corrosion resistant alloy material, intersects one or more layers of underburden 20 and then intersects a second hydrocarbon formation 22. The tubular casing sections 14, 14L which intersect the hydrocarbon formations 18 and 22 are perforated by multiple openings 24, 26, respectively, formed through the casing sidewalls to permit entry of formation fluids from the producing formations 18, 22, respectively.

The well is sealed by the bottom packer 10 with an expendable sealing plug in place, and is set by electric wire line and explosive charge for isolation of the lower production zone 22 after perforating and while working on the upper producing zone 18. After perforating the upper producing zone 18, a dual bore hydraulic packer 28 is installed against the bore 12 of the upper casing string 14. Each production zone 18, 22 is separately produced through an independent, primary tubing string 30 and a secondary tubing string 32. The dual production tubing strings 30, 32 are extended to a surface wellhead assembly (not illustrated). The portion of the primary tubing string 30 which is suspended below the dual bore packer 28 is preferably made of a flow-wetted CRA material, for example INCALOY 925.

The dual bore, retrievable hydraulic packer 28 includes an expandable seal assembly 34 and a slip anchor assembly 36, both radially extendable to engage the bore 12 of the surrounding well casing 14. Each slip anchor assembly 36 includes a plurality of anchor slips which are mounted for radial movement through rectangular windows formed in a tubular slip carrier. While the number of anchor slips may be varied, the tubular slip carrier is provided with an appropriate corresponding number of windows, with four anchor slips being preferred. Each of the anchor slips includes lower and upper gripping surfaces, respectively, positioned to extend radially through the windows. The wall area of the slip carrier between the paired rectangular windows confines a coil or leaf spring which resides in a pocket of the anchor slip.

The coil spring biases the anchor slip radially inwardly relative to the wall of the slip carrier, thereby maintaining the gripping surfaces retracted in the absence of setting forces displacing the anchor slips radially outwardly. Each of the gripping surfaces has horizontally oriented, continuous gripping edges which provide gripping engagement in each direction of longitudinal movement of the packer 28. The continuous gripping edges are radially curved to conform with the cylindrical internal surface of the well casing bore against which the anchor slips are set. Preferably, the retrievable, dual bore packer 28 is constructed as described in U.S. Pat. No. 4,930,573, which is incorporated herein by reference.

Figure 2:
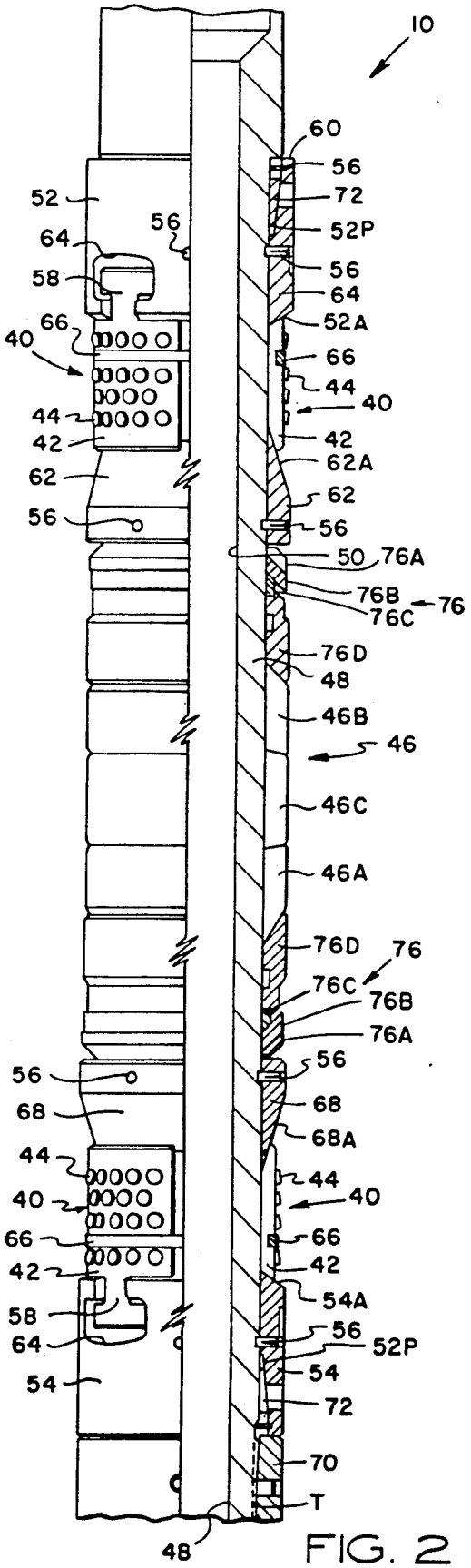
FIG. 2 is a longitudinal sectional view of the single string bottom packer shown in FIG. 1.

Referring now to FIG. 2, the permanent set, bottom hole production packer 10 is equipped with upper and lower anchor slip assemblies 40, each of which includes a slip body or plate 42 and anchor studs 44 constructed according to the present invention. The single bore, permanent packer 10 includes an expandable seal element assembly 46 which is radially extendable as described hereinafter to engage the bore 12L of the surrounding liner casing 14L. The anchor slip assemblies 40 and seal element assemblies 46 are slidably mounted on a tubular mandrel 48 which has a longitudinal flow passage bore 50 which is connected in flow communication with the production tubing string 30.

The seal element assembly 46 is mounted directly onto the external surface of the packer mandrel 48. The expandable seal element assembly 46 includes two end seal elements 46A, 46B and a center seal element 46C. The seal element package also includes backup seal assemblies 76 in which seal elements 76A, 76B, 76C and 76D are mounted above and below the end seals 46A, 46B, respectively. The seal elements are preferably constructed of a propylene-tetrafluoroethylene copolymer such as AFLAS® manufactured by Asahi Glass Company which are adapted for use in corrosive service applications. Elastomeric/nitrile seal elements may be used for standard service applications. The type, shape, number and method of mounting the seal elements included in the seal assembly 46 may be varied as known in the art while still providing a seal assembly that may be expanded radially to selectively engage the liner bore 12L surrounding the packer 10.

The anchor slip assemblies 40 are mounted directly onto the external surface of the packer mandrel 48, and are retained by upper and lower slip carriers 52, 54, respectively. The slip carriers 52, 54 are pinned to the packer mandrel 48 by shear pins 56.

The slip plates 42 are coupled to the slip carriers 52, 54 by Tee connectors 58. The Tee connectors 58 are received within windows 60 formed through the slip carrier sidewall. While the number of anchor slips 40 may be varied, the tubular slip carrier 52 is provided with a corresponding number of windows 60, with four anchor slips 40 being preferred at each end of the packer.

In this exemplary embodiment, the anchor slips 40 and the seal elements 46 are extended radially into set engagement against the well casing by a wire line explosive charge setting tool (not illustrated). The setting tool is pinned to the packer and is run into the well engaging against a setting shoulder 60 formed on the slip carrier 52. Alternatively, a hydraulic setting tool or a mechanical setting tool may be used to apply the setting force. The upper anchor slips 42 are confined between a tapered wedge 62 and a wedge shoulder portion 64 of the slip carrier 52. As the explosive charge fires, the setting force causes the shear pins 56 to shear, thereby driving the anchor slips 40 downwardly along the packer mandrel 48.

Initially, the anchor slips 42 are secured against radial displacement by a metal tie strap 66 which encircles all four of the anchor slips. In response to the longitudinal setting force, the slip carrier 52, anchor slips 40 and setting wedge 62 are driven downwardly against the seal element assembly 46. The setting force also shears the pins 56, thereby permitting a wedge 68 to be driven downwardly against the lower anchor slips 40. The setting force is reacted through the lower slip carrier 54 and a retaining collar 70 which is secured onto the packer mandrel 48 by a threaded union T. As the anchor slips are extended radially outwardly, the upper and lower tie straps 66 separate. The upper slip carrier 52 has a ramp face 52A, and the setting wedges have ramp surfaces 62A, 68A which drive the anchor slip bodies 42 radially outwardly in response to the setting force.

The set position (FIG. 9) of the anchor slip bodies 42 is secured by the unidirectional ratcheting action of a set of segmented, internal locking slips 72 which are interposed between the packer mandrel and the internal bore of the slip carrier 52. The ratchet slips 72 are received within a slip pocket 52P having a tapered counterbore formed along the inside of the slip carrier 52. Each locking slip 72 has fine, sharp teeth which engage and bite into the external surface of the packer mandrel 48. The ratchet teeth permit the slip carrier 52 to ratchet downwardly along the packer mandrel surface, but upward retraction movement is prevented by the wedging action and biting engagement of the locking slips against the packer mandrel.

Consequently, once the anchor slips 40 have been extended radially into set engagement and the seal elements 46 have been compressed and expanded into engagement against the well casing, the set position is securely locked against retraction by the locking slips after the explosive setting force has been applied. The energy stored in the compressed seal elements 46 is trapped between the set position of the upper and lower external anchor slips 40.

Figure 3:
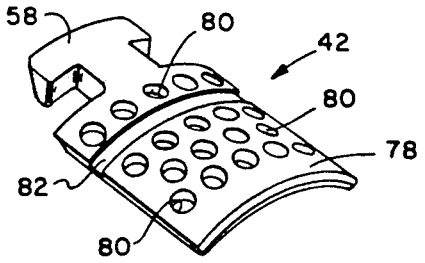
FIG. 3 is a perspective view of an anchor slip constructed according to the present invention.
Figure 4:
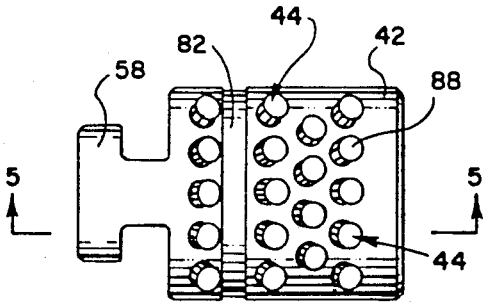
FIG. 4 is a top plan view of the anchor slip shown in FIG. 3, including anchor studs mounted thereon according to the present invention.
Figure 5:
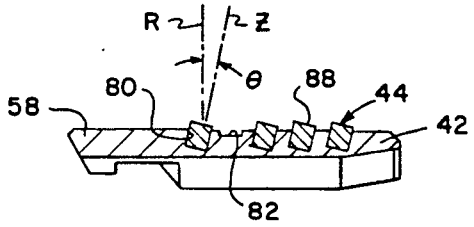
FIG. 5 is a sectional view of the slip anchor shown in FIG. 4, taken along the lines 5—5.

Referring now to FIG. 3, FIG. 4 and FIG. 5, the slip plate 42 of the present invention has a semicylindrical body section 78 which is intersected by an array of blind bores 80. The slip plate body 78 is also intersected by an annular slot 82 which receives the metal tie strap 66.

An anchor stud 44 is loaded into bore 80 in a press-fit interference union with the slip plate body. Preferably, the bores 80 are distributed substantially uniformly across the slip plate body 78 in parallel, circumferentially extending rows, with the bores 80 in one intermediate row being angularly displaced with respect to neighboring rows. Moreover, the bores 80 intersect the slip plate body 78 at an acute angle $\theta$ (FIG. 5) with respect to the horizontal radial axis R! of each bore.

Referring now to FIG. 5, FIG. 6, FIG. 7 and FIG. 8, each anchor stud 44 has a main body portion 84 having a longitudinal axis Z in the form of a right solid cylinder having a radius RI. The slip anchor stud 44 also has a plurality of ribs 86 integrally formed with the main body portion 84, with the ribs projecting radially from the main body portion along the radius R2 and extending along its length.

The main body portion 84 and the ribs 86 are truncated along a planar face 88. The intersection of the planar face 88 with the ribs 86 defines a sharp cutting edge 90 for penetrating and gripping the well casing 14.

Preferably, the ribs 86 extend longitudinally substantially in parallel alignment with the axis Z. Additionally, the ribs 86 are preferably symmetrically disposed with respect to a reference plane constructed in colinear relation with the longitudinal axis Z. In this preferred embodiment, the ribs 86 extend along the body portion 84 substantially in parallel alignment with the longitudinal axis Z, and the ribs are circumferentially spaced with respect to each other by substantially equal angular displacements $\Phi$. The ribs are characterized as longitudinal serrations 86 which are separated by longitudinal grooves 92.

Figure 6:
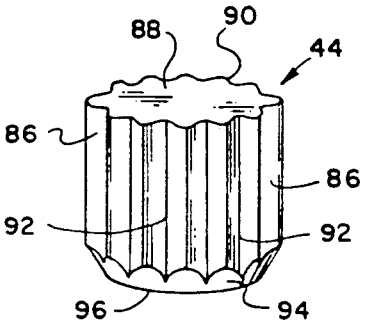
FIG. 6 is a perspective view of an anchor stud constructed according to the present invention.
Figure 7:
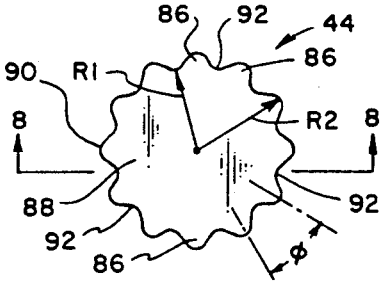
FIG. 7 is a top plan view thereof.

Referring to FIG. 6, the main body portion of the anchor stud 84 and the ribs 86 are truncated on the lower end of the stud along an annular face 94. Preferably, the annular face 94 is a conical surface, with the lower end of the stud being further truncated by a lower planar face 96. Preferably, the radius R3 of the lower planar face 96 is slightly smaller than the radius R1 of the main body portion 84 to facilitate insertion of the stud 44 into the blind bore 80.

The radius R2 of the main body, portion, which is coincident with the apex of each rib 86, is greater than the radius of the blind bore 80 formed in the slip plate 78. According to this arrangement, as the anchor stud 44 is pressed into the blind bore 80, the ribs 86 deform and flow into the groove space 92. The compression force is great enough to produce a metallurgically integral union between the anchor studs 44 and the anchor slip body 78. The term "metallurgically integral union" as used herein means that the anchor stud material is bonded to the anchor slip material by interatomic diffusion as a result of the high compression forces applied. The interatomic diffusion occurs as cold flow slip plate material intermingles with cold flow anchor stud material within the press-fit interference union.

Preferably, the anchor slip plate 78 is constructed of a CRA material, and each stud is made of a material which has a hardness substantially greater than the hardness of the casing 14. In this exemplary embodiment, the lower casing liner 14L is also made of a CRA alloy material, and the anchor studs 44 are preferably made of carbide compounds including refractory carbides and cemented refractory carbides. Carbide compounds which may be used to good advantage are solid refractory carbides consisting of carbon compounded with an element selected from the group including silicon, boron, tungsten, molybdenum and tantalum. The preferred carbide compound is a refractory carbide united by compression and sintering with cobalt.

Figure 9:
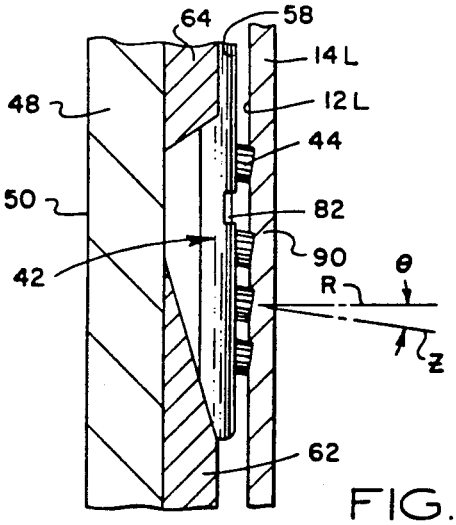
Figure 8:
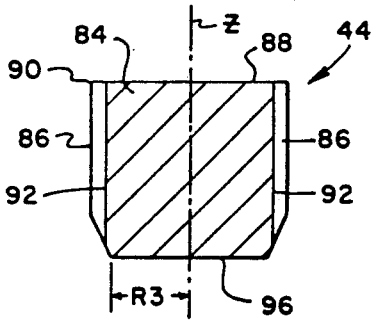
FIG. 8 is a sectional view thereof taken along the lines 8—8 or FIG. 7; and, FIG. 9 is a sectional view, partially broken away, of the upper anchor slip assembly of FIG. 2, shown in set engagement against a well casing.

Referring now to FIG. 9, the slip plate 42 is shown in its fully extended, set position against the well casing 14. Each anchor stud 44 is inclined with respect to the horizontal axis R by the acute angle $\theta$, thereby presenting the cutting edge 90 of each stud 44 at a corresponding acute angle with respect to the inside diameter bore surface of the CRA liner casing 14L. According to this arrangement, the anchor studs 90 penetrate radially into the liner casing 14L, thereby providing a secure hold-down against upwardly directed pulling forces which may be applied onto the packer mandrel 48.

The top slip carrier 52 forces the upper slip assembly 40 downward. The ramp surface 62A of the wedge 62 forces the slip plate body 42 radially outwardly against the liner casing bore 12L. The heel 58 (FIG. 5) of the anchor slip body 42 and the slip carrier shoulder 52A are tapered to force the slip body radially outward. Typical penetration of the anchor studs 44 into the lower liner casing 14L is 0.030–0.050 inch. The depth of penetration shown in FIG. 9 is exaggerated somewhat for illustration purposes.

The anchor studs 44 are oriented oppositely in the lower anchor slip assembly 40 for penetrating the well casing liner 14L and for opposing and reacting set down/hang weight forces which may be applied to the packer mandrel 48.

Because the hardness of the carbide anchor studs 44 is substantially greater than the hardness of the liner well casing 14L, even if the liner well casing 14L is constructed of a corrosion resistance alloy (CRA) material, the cutting edge 90 of each anchor stud 44 cuts into and penetrates the liner well casing 14L easily, thereby providing a reliable, long lasting anchor under highly corrosive well conditions. The anchor slips and other packer components are likewise constructed of CRA material, and the anchor studs are securely attached to each anchor slip plate by a press-fit interference union. Since the anchor studs are uniformly distributed over the slip plate, the compression loading is also uniformly distributed, thereby permitting a reduction in the radial thickness of the slip plate material and providing a relatively thin slip plate body. That is, instead of having line contact along multiple lines, as in conventional anchor slips, the anchor studs provide multiple load contact points so that the setting load, biting load and reaction load are substantially uniformly distributed along the slip body, thereby avoiding compression/stress failure. Conventional carbon steel anchor slips are characterized by about 40,000–60,000 minimum psi yield strength in a buckling mode or load transfer mode. However, when the slip plate 78 is constructed of CRA material, its yield strength in the buckling mode is increased to about 105,000–125,000 psi. This produces a stronger slip which yields a thinner slip body, thereby allowing a larger inside diameter (I.D.) flow passage through the packer and resulting in a larger bore production flow conduit for the well.

The invention has been described with reference to a permanent bottom packer in a vertical completion. However, the anchor slips and stud arrangement of the present invention can be utilized in multiple bore as well as single bore packers, in non-corrosive as well as corrosive environments, and in deviated bore as well as vertical bore completions. Various modifications of the disclosed embodiment as well as alternative well completion applications of the invention will be suggested to persons skilled in the art by the foregoing specification and illustrations. It is therefore contemplated that the appended claims will cover any such modifications or embodiments that fall within the true scope of the invention.

What is claimed is:

1. A slip anchor stud for use in combination with a well packer comprising a main body portion having a length dimension and a radius dimension, a plurality of ribs formed on said main body portion, said ribs projecting radially from and extending along the length of said main body portion, each rib having a longitudinal apex portion separated by longitudinal grooves formed in said main body portion, wherein the apex of each rib has a convex radius of curvature and each longitudinal groove has a concave radius of curvature, with the convex radius of curvature of each rib apex not exceeding the concave radius of curvature of each groove.

2. A slip anchor stud as defined in claim 1, said main body portion and ribs being truncated along a planar face, the intersection of said planar face with said ribs defining a cutting edge.

3. A slip anchor stud as defined in claim 1, said main body portion and ribs being truncated along an annular face which extends transversely with respect to said main body portion.

4. A slip anchor stud as defined in claim 3, said annular face being a conical surface.

5. A slip anchor stud as defined in claim 1, said main body portion having a longitudinal axis, said ribs extending longitudinally substantially in parallel alignment with said axis.

6. A slip anchor stud as defined in claim 1, said main body portion having a longitudinal axis, said ribs being symmetrically disposed with respect to a reference plane constructed in colinear relation with said longitudinal axis.

7. A slip anchor stud as defined in claim 1, said main body portion having the form of a right solid cylinder.

8. A slip anchor stud as defined in claim 1, said main body portion having a longitudinal axis, said ribs extending along said body portion substantially in parallel alignment with said axis, and said ribs being circumferentially spaced with respect to each other by substantially equal angular displacement.

9. A slip anchor stud as defined in claim 1, wherein said main body portion and said ribs are integrally formed of a carbide compound.

10. A slip anchor stud as defined in claim 9, wherein said carbide compound is a solid refractory carbide consisting of carbon compounded with an element selected from the group including silicon, boron, tungsten, molybdenum and tantalum.

11. A slip anchor stud as defined in claim 9, wherein said carbide compound is a refractory carbide united by compression and sintering with cobalt, where the refractory carbide consists of carbon compounded with an element selected from the group including silicon, boron, tungsten, molybdenum and tantalum.

12. An anchor slip for use in combination with a well packer comprising, in combination:

a slip plate intersected by a plurality of bores defining pockets for receiving anchor studs; and, a plurality of anchor studs disposed in said pockets in a press-fit interference union with said slip plate, respectively, each anchor stud having an end portion projecting from said slip plate for penetrating and gripping a well casing.

13. An anchor slip assembly as defined in claim 12, each anchor stud comprising:

a main body portion having a length dimension and a radius dimension, a plurality of ribs formed on said main body portion, said ribs projecting radially from and extending along the length of said main body portion.

14. An anchor slip assembly as defined in claim 12, the projecting end portion of each anchor stud being truncated along a planar face, the intersection of said planar face with said end portion defining a cutting edge.

15. An anchor slip assembly as defined in claim 12, each anchor stud being truncated along an annular face which extends transversely with respect to said end portion.

16. An anchor slip assembly as defined in claim 15, said annular face being a conical surface.

17. An anchor slip assembly as defined in claim 12, each stud including a main body portion having a longitudinal axis and external ribs extending longitudinally substantially in parallel alignment with said axis.

18. An anchor slip assembly as defined in claim 17, said main body portion having a longitudinal axis, said ribs being symmetrically disposed with respect to a reference plane constructed in colinear relation with said longitudinal axis.

19. An anchor slip assembly as defined in claim 12, each stud having the form of a right solid cylinder.

20. An anchor slip assembly as defined in claim 12, each stud including a main body portion having a longitudinal axis and ribs extending along said main body portion substantially in parallel alignment with said axis, and said ribs being circumferentially spaced with respect to each other by substantially equal angular displacement.

21. An anchor slip assembly as defined in claim 20, said ribs being longitudinal serrations separated by longitudinal grooves formed in said main body portion.

22. An anchor slip assembly as defined in claim 12, wherein each stud is formed of a carbide compound.

23. An anchor slip assembly as defined in claim 22, wherein said carbide compound is a solid refractory carbide consisting of carbon compounded with an element selected from the group including silicon, boron, tungsten, molybdenum and tantalum.

24. An anchor slip assembly as defined in claim 22, wherein said carbide compound is a refractory carbide united by compression and sintering with cobalt, where the refractory carbide consists of carbon compounded with an element selected from the group including silicon, boron, tungsten molybdenum and tantalum.

25. An anchor slip assembly as defined in claim 12, wherein said slip plate is constructed of a corrosion resistant alloy material.

26. An anchor slip assembly as defined in claim 12, wherein each anchor stud is joined to said slip plate by interatomic diffusion resulting from intermingling of cold flow slip plate material and anchor stud material within the press-fit interference union.

27. An anchor slip assembly as defined in claim 12, wherein said bores and studs being disposed in a plurality of circumferentially extending rows, said rows being longitudinally spaced with respect to each other.

28. An anchor slip assembly as defined in claim 27, wherein the bores and studs of at least one row being angularly offset with respect to the studs and bores of at least one other row.

29. An improved well packer of the type including a tubular body mandrel having a longitudinal flow passage, a seal element assembly mounted on said tubular body mandrel, an anchor slip assembly mounted on said tubular body mandrel and force transmitting apparatus movably coupled to said seal element assembly and said anchor slip assembly for extending said seal element assembly and said anchor slip assembly into set engagement against a well bore, wherein the anchor slip assembly comprises:

a slip plate intersected by a plurality of bores defining pockets for receiving anchor studs; and, a plurality of anchor studs disposed in said pockets in a press-fit interference union with said slip plate, respectively, each anchor stud having an end portion projecting from said slip plate for penetrating and gripping a well casing.

30. The improved well packer as defined in claim 29, each anchor stud comprising:

a main body portion having a length dimension and a radius dimension, a plurality of ribs formed on said main body portion, said ribs projecting radially from and extending along the length of said main body portion.

31. The improved well packer as defined in claim 29, the projecting end portion of each anchor stud being truncated along a planar face, the intersection of said planar face with said end portion defining a cutting edge.

32. The improved well packer as defined in claim 29, each anchor stud being truncated along an annular face which extends transversely with respect to said end portion.

33. The improved well packer as defined in claim 32, said annular face being a conical surface.

34. The improved well packer as defined in claim 29, each anchor stud including a main body portion having a longitudinal axis and external ribs extending longitudinally substantially in parallel alignment with said axis.

35. The improved well packer as defined in claim 34, said main body portion having a longitudinal axis, said ribs being symmetrically disposed with respect to a reference plane constructed in colinear relation with said longitudinal axis.

36. The improved well packer as defined in claim 29, each anchor stud having the form of a right solid cylinder.

37. The improved well packer as defined in claim 29, each anchor stud including a main body portion having a longitudinal axis and ribs extending along said main body portion substantially in parallel alignment with said axis, and said ribs being circumferentially spaced with respect to each other by substantially equal angular displacement.

38. The improved well packer as defined in claim 37, said ribs being longitudinal serrations separated by longitudinal grooves formed in said main body portion.

39. The improved well packer as defined in claim 29, wherein each anchor stud is formed of a carbide compound.

40. The improved well packer as defined in claim 39, wherein said carbide compound is a solid refractory carbide consisting of carbon compounded with an element selected from the group including silicon, boron, tungsten, molybdenum and tantalum.

41. The improved well packer as defined in claim 39, wherein said carbide compound is a refractory carbide united by compression and sintering with cobalt, where the refractory carbide consists of carbon compounded with an element selected from the group including silicon, boron, tungsten molybdenum and tantalum.

42. The improved well packer as defined in claim 29, wherein said slip plate is constructed of a corrosion resistant alloy material.

43. The improved well packer as defined in claim 29, wherein each anchor stud is joined to, said slip plate by interatomic diffusion resulting from intermingling of cold flow slip plate material and anchor stud material within the press-fit interference union.

44. The improved well packer as defined in claim 29, wherein said bores and studs being disposed in a plurality of circumferentially extending rows, said rows being longitudinally spaced with respect to each other.

45. The improved well packer as defined in claim 44, wherein the bores and studs of at least one row being angularly offset with respect to the studs and bores of at least one other row.

* * * * *